United States Patent [19]

Naifeh

[11] 4,354,313

[45] Oct. 19, 1982

[54] SLIDE LOCK FOLDING BLADE KNIFE

[76] Inventor: Woodrow W. Naifeh, Rte. 13, Box 380, Tulsa, Okla. 74107

[21] Appl. No.: 215,241

[22] Filed: Dec. 11, 1980

[51] Int. Cl.[3] ..... B26B 1/04

[52] U.S. Cl. ..... 30/161

[58] Field of Search ..... 30/160, 161, 153, 154

[56] References Cited

U.S. PATENT DOCUMENTS

| | | | |
|---|---|---|---|
| 509,819 | 11/1893 | Meerroth | 30/154 X |
| 873,206 | 2/1907 | Berns | 30/161 |
| 1,036,664 | 8/1912 | Marble | 30/161 X |
| 1,415,887 | 5/1922 | McWilliams | 30/161 |
| 1,443,701 | 1/1923 | Comstock | 30/161 |
| 1,972,147 | 9/1934 | Jones | 30/161 X |
| 3,930,309 | 1/1976 | Collins | 30/161 |

*Primary Examiner*—Jimmy C. Peters

*Attorney, Agent, or Firm*—Head, Johnson & Stevenson

[57] ABSTRACT

A slide lock folding blade knife comprising a blade pivotally carried between spaced handle plates, a sleeve member slidably carried by the handle plates, the sleeve member having a first position adjacent to the blade pivot point and engageable with the blade for holding the blade in either a fully open position or a fully closed position, the sleeve having a second opposite retracted position clear of the blade during opening or closing of the blade and a thumb-operated locking leaf carried by the handle for selectively locking the sleeve member in its first position.

9 Claims, 7 Drawing Figures

SLIDE LOCK FOLDING BLADE KNIFE

BACKGROUND OF THE INVENTION

1. Field of the Invention

The present invention relates to a folding blade knife, and more particularly, but not by way of limitation, to a springless folding blade knife having a sliding sleeve member for locking the blade in a fully open or a fully closed position.

2. History of the Prior Art

The conventional folding blade pocketknife, which utilizes a spring-loaded knife blade has several disadvantages from the standpoints of safety and ease of use.

The knives are generally difficult to open causing injury to the user's fingernails. On the other hand, if the knife is easy to open, it may come open accidentally in the pocket.

Such conventional knives are held in the open position by a spring face against a cam member and therefore can be easily dislodged and accidentally closed causing injury to the user. Injury also often occurs during closing of such knives since after reaching a breakover point, they tend to snap closed under spring pressure.

A relatively recent innovation to pocketknives is a releasable locking mechanism which firmly locks the blade in an open position. In order to close such knives, a lever must be depressed. However, there is very little force required to open such knives, hence, permitting the knife to come open accidentally.

SUMMARY OF THE PRESENT INVENTION

The present invention provides a springless folding blade knife wherein the blade is pivotally supported between a pair of handle plate members such that the blade may fold into the handle member in a closed position or be pivoted 180° to a fully open position.

The blade member comprises a butt end portion around the pivot point which has a width equal to the width of the handle plate members adjacent the pivot point. A sliding sleeve member is disposed around the handle members and has a rectangular aperture therethrough. The aperture has a width substantially equal to the width of the handle plate members and the width of the butt end portion of the knife blade whereby when the knife blade is in a fully open position, the sliding sleeve member may be moved forwardly so that the butt end portion of the blade is held firmly in position thereby preventing the knife from accidentally closing without first retracting the sleeve member. The handle member carries a depressable leaf portion for selectively locking the sleeve member in its forward most position.

In order to close the knife blade, the latching mechanism is depressed and the sleeve member retracted to the opposite end of the handle. The knife blade is then freely rotated so that the cutting portion of the knife blade is carried between the handle plate members. The sleeve member is then moved into its forward most position and latched into place thereby firmly locking the knife blade in the closed position.

Therefore, the present invention provides a simply constructed folding blade knife which is lockable in either a fully open position or a closed position and has no spring tension acting on the blade during the opening or closing operation.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENT

Figure 1:
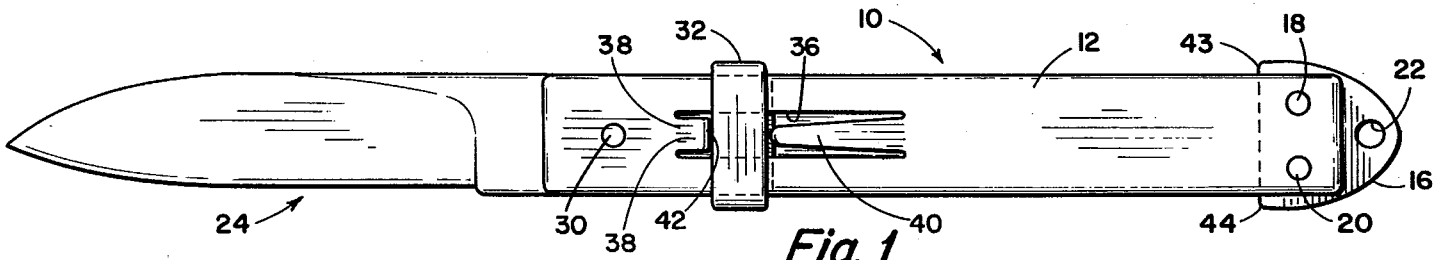
FIG. 1 depicts a top plan view of a folding blade knife embodying the present invention in a fully open position.

Referring to the drawings in detail, reference character 10 generally indicates a slide lock folding blade knife comprising a pair of elongated handle plate members 12 and 14 made of stainless steel or other suitable metal, an end spacing plate member 16 is secured between the handle members 12 and 14 by way of a pair of rivets 18 and 20. The spacer plate 16 extends outwardly from the end of the handle plates and is provided with an aperture 22 for receiving a chain or other device (not shown) therethrough.

An elongated blade member generally indicated by reference character 24 is provided with a substantially rectangular shaped butt end portion 26 and an oppositely disposed cutting edge portion 28. The butt end portion 26 is pivotally secured between the handle plate members 12 and 14 by means of a suitable pivot pin 30.

Figure 2:
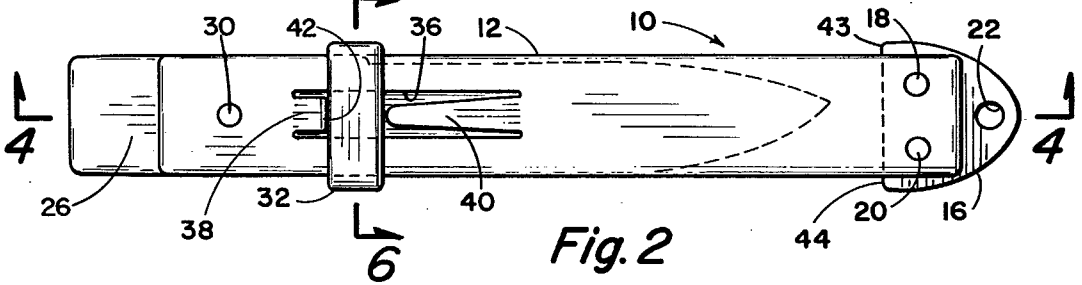
FIG. 2 depicts the knife of FIG. 1 in a fully closed position.

The cutting portion 28 of the blade 24 has a width equal to or less than the width of the handle members 12 and 14 so that when the blade is in a closed position as shown in FIG. 2, it is completely contained between said handle plate members 12 and 14.

A rectangular shaped sleeve member 32 is slidably disposed around the handle plate members 12 and 14 and is provided with a rectangular aperture 34 therethrough, which substantially conforms to the cross-sectional shape of the spaced handle plate members 12 and 14.

Figure 3:
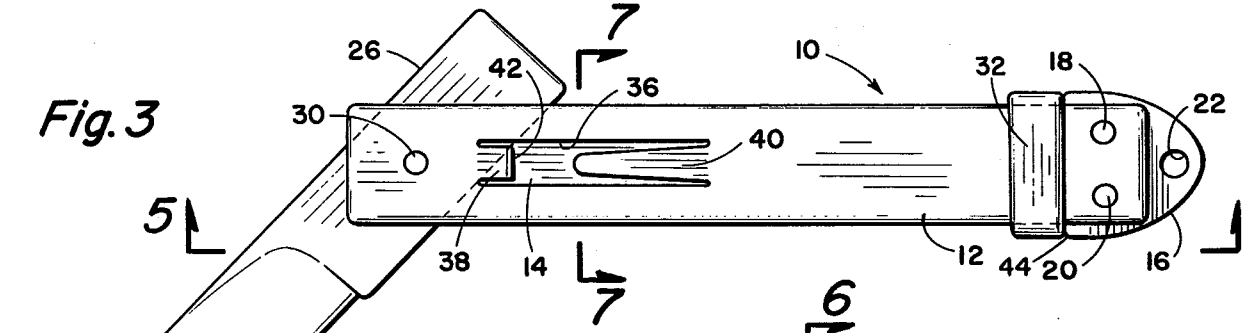
FIG. 3 depicts the knife of FIG. 1 in a partially open position.

Therefore, the sleeve member 32 may be slidably moved along the handle plate members 12 and 14 when the knife is in a fully closed position as shown in FIG. 2 or an open or partially open position as shown in FIGS. 1 and 3.

A shaped aperture 36 is provided in the handle plate 12 adjacent the pivot pin 30. The aperture 36 may be stamped out of the plate member or otherwise formed therein leaving a pair of inwardly facing longitudinal leaf members 38 and 40 therein. The leaf member 38 is at the end of the aperture 36 adjacent the pivot pin 30 and has the inner end 42 thereof turned upwardly to form a stop member for the sleeve 32 as will be hereinafter set forth.

Figure 4:
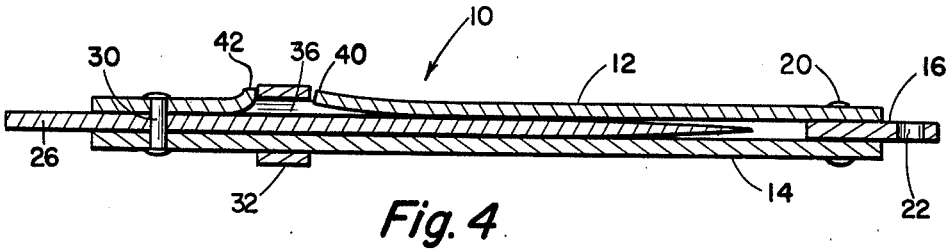
FIG. 4 is a side sectional view of the knife of FIG. 2 taken along the broken lines 4—4 of FIG. 2.

The leaf member 40 is longer than the leaf member 38 and is turned upwardly to form a spring-loaded thumb-operated locking member as will be hereinafter set forth. The space between the stop member 42 and the locking member 40 is of a width sufficient to receive the sleeve member 32 therebetween as shown in FIGS. 1, 2 and 4.

Figure 5:
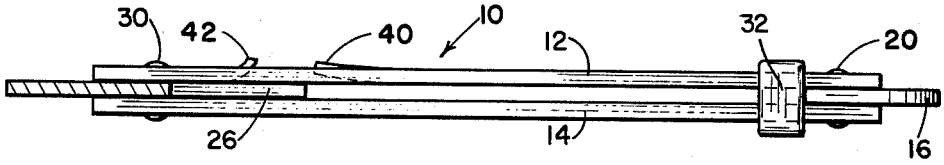
FIG. 5 is a side sectional view of the knife of FIG. 3 taken along the broken lines 5—5 of FIG. 3.
Figure 6:
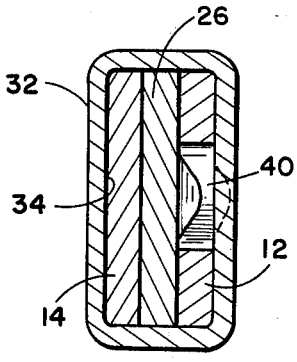
FIG. 6 is an end sectional view of the knife of FIG. 2 taken along the broken lines 6—6 of FIG. 2.
Figure 7:
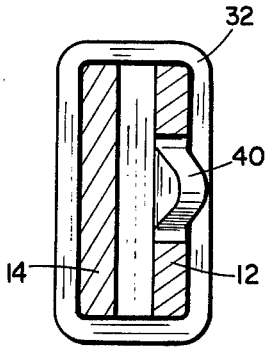
FIG. 7 is an end sectional view of the knife of FIG. 3 taken along the broken lines 7—7 of FIG. 3.

It is also noted that the length of the handle plates 12 and 14 are such that when the sleeve member 32 is in a fully retracted position as shown in FIGS. 3 and 5, the knife blade end may be moved to a fully closed position thereby clearing the sleeve member 32.

It is further noted that the spacer plate 16 at the end of the knife handle plates extends outwardly on each side of the handle plates to form shoulders 43 and 44 which may serve as a stop member to retain the sleeve 32 on the handle plates.

However, it is noted that if the rectangular aperture 34 is properly sized, the outwardly extending rivet pins 18 and 20 will effectively serve as stop members to prevent complete removal of the sleeve member 32 when in its retracted position as shown in FIG. 3.

In operation when the knife is fully closed as shown in FIG. 2, it may be locked in the closed position by sliding the sleeve member 32 forward over the locking member 40. As can be seen by the dashed lines of FIG. 2, the blade is held in a firmly closed position since the sleeve member 32 overlaps a portion of the rectangular butt end portion 26 of the knife blade 24.

In order to open the knife the thumb may be used to depress the locking member 40 and simply slide the sleeve member 32 to its most retracted position as shown in FIG. 3 whereupon the knife blade may be freely swung to an open position.

Once the knife blade has been moved to a fully open position as shown in FIG. 1, the sleeve member 32 is moved forwardly on the handle member until it passes over and depresses the locking member 40 thereby again gripping the butt end portion 26 of the blade within the sleeve member aperture. In this position it is seen that the knife blade will be fully locked in an open position until the sleeve member is again retracted by depressing the locking member 40.

From the foregoing it is apparent that the present invention provides a slide lock folding blade knife which is simple in construction and very easy to use. It is further apparent that the safety of the folding blade knife is enhanced by the absence of a spring member constantly acting on the knife blade itself while at the same time providing a positive locking mechanism for locking the blade in either a fully open position or a fully closed position.

Whereas the present invention has been described in particular relation to the drawings attached hereto, other and further modifications apart from those shown or suggested herein may be made within the spirit and scope of the invention.

What is claimed is:

1. A slide lock knife comprising a pair of shaped elongated handle plates, an elongated blade, a pivot pin pivotally connecting the blade between the handle plates, a sleeve member slidably carried by the handle plates, said sleeve member having a first position adjacent to the blade pivot pin and engageable with the blade for holding the blade in either a fully open or a fully closed position, and a second opposite retracted position clear of the blade for opening or closing the blade and locking means for selectively locking the sleeve member in the first position.

2. A knife as set forth in claim 1 wherein the blade comprises a rectangular butt end portion, said pivot pin extending through said butt end portion wherein said sleeve is engageable with the butt end portion on one side of the pivot pin when the blade is in a locked closed position and engageable with the butt end portion on the opposite side of the pivot pin when the blade is locked in an open position.

3. A knife as set forth in claim 1 and including a first stop member carried by the handle plates engageable with the sleeve member in its retracted position.

4. A knife as set forth in claim 3 and including a second stop member adjacent the pivot pin and engageable with the sleeve member in its first position.

5. A knife as set forth in claim 1 wherein the sleeve member comprises an aperture having a shape and size compatible with the handle plates in the proximity of the pivot pin for snugly sliding therealong.

6. A knife as set forth in claim 1 wherein the locking means comprises a yieldable leaf member secured to one of the handle plates, a recess provided in said handle plate for receiving the leaf member therein when depressed, said leaf member being engageable with the sleeve member when the sleeve member is in its first position for selectively locking said sleeve member in said first position.

7. A knife as set forth in claim 6, wherein the leaf member comprises a first end secured to the handle, the opposite end extending outwardly out of said recess and toward the pivot pin whereby said leaf may be depressed manually or by moving the sleeve member into its first position.

8. A knife as set forth in claim 7 wherein the handle plate is formed of metal and the recess and leaf member are formed by a shaped aperture through said handle plate, the free end of the leaf member being bent outwardly.

9. A knife as set forth in claim 8 wherein said aperture includes a protrusion adjacent the pivot pin, said protrusion being bent outwardly to form a stop member engageable with the sleeve member in its first position whereby said sleeve member in its first position is locked between the free end of the leaf member and said stop member.

* * * * *

UNITED STATES PATENT AND TRADEMARK OFFICE

CERTIFICATE OF CORRECTION

PATENT NO. : 4,354,313

DATED : October 19, 1982

INVENTOR(S) : Woodrow W. Naifeh

It is certified that error appears in the above-identified patent and that said Letters Patent is hereby corrected as shown below:

Column 1, line 21, change "face" to --force--.

Signed and Sealed this

*Seventeenth* Day of *April 1984*

[SEAL]

*Attest:*

GERALD J. MOSSINGHOFF

*Attesting Officer*

*Commissioner of Patents and Trademarks*